US009670420B2

(12) United States Patent
Yanagawa et al.

(10) Patent No.: US 9,670,420 B2
(45) Date of Patent: Jun. 6, 2017

(54) METHOD FOR PRODUCING MONOCYCLIC AROMATIC HYDROCARBON

(71) Applicant: JX Nippon Oil & Energy Corporation, Tokyo (JP)

(72) Inventors: Shinichiro Yanagawa, Tokyo (JP); Masahide Kobayashi, Tokyo (JP); Yukihiro Yoshiwara, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 36 days.

(21) Appl. No.: 14/437,532

(22) PCT Filed: Oct. 25, 2013

(86) PCT No.: PCT/JP2013/079040

§ 371 (c)(1),
(2) Date: Apr. 22, 2015

(87) PCT Pub. No.: WO2014/065419

PCT Pub. Date: May 1, 2014

(65) Prior Publication Data

US 2015/0259610 A1 Sep. 17, 2015

(30) Foreign Application Priority Data

Oct. 25, 2012 (JP) ..... 2012-236134

(51) Int. Cl.
*C10G 11/05* (2006.01)
*C10G 11/10* (2006.01)
(Continued)

(52) U.S. Cl.
CPC ..... *C10G 11/05* (2013.01); *C10G 11/10* (2013.01); *C10G 35/095* (2013.01);
(Continued)

(58) Field of Classification Search
CPC ..... C10G 11/05; C10G 11/10; C10G 35/095; C10G 49/002; C10G 69/04; C10G 2300/1096; C10G 2400/30
See application file for complete search history.

(56) References Cited

U.S. PATENT DOCUMENTS 4,456,527 A 6/1984 Buss et al.
5,002,915 A * 3/1991 Harandi ..... C10G 50/00 208/78

(Continued)

FOREIGN PATENT DOCUMENTS

EP 2050731 A1 4/2009
EP 2438988 A1 4/2012

(Continued)

OTHER PUBLICATIONS

Speight, James G., ed. Petroleum chemistry and refining. CRC Press, 1997.*

(Continued)

*Primary Examiner* — In Suk Bullock
*Assistant Examiner* — Youngsul Jeong
(74) *Attorney, Agent, or Firm* — Panitch Schwarze Belisario & Nadel LLP

(57) ABSTRACT

A method for producing a monocyclic aromatic hydrocarbon of the present invention includes a cracking and reforming reaction step of obtaining a product containing a monocyclic aromatic hydrocarbon having 6 to 8 carbon atoms by bringing a feedstock oil having a 10 volume % distillate temperature of 140° C. or higher and a 90 volume % distillate temperature of 390° C. or lower and a saturated hydrocarbon having 1 to 3 carbon atoms into contact with a catalyst for producing a monocyclic aromatic hydrocarbon containing
(Continued)

crystalline aluminosilicate, which is loaded into a fixed-bed reactor, and reacting the feedstock oil and the saturated hydrocarbon.

7 Claims, 2 Drawing Sheets

(51) Int. Cl.
*C10G 69/04* (2006.01)
*C10G 35/095* (2006.01)
*C10G 49/00* (2006.01)

(52) U.S. Cl.
CPC ..... *C10G 49/002* (2013.01); *C10G 69/04* (2013.01); *C10G 2300/1096* (2013.01); *C10G 2400/30* (2013.01)

(56) References Cited

U.S. PATENT DOCUMENTS

| | | | | |
|---|---|---|---|---|
| 5,877,368 | A | 3/1999 | Kiyama et al. | |
| 6,124,515 | A * | 9/2000 | Wu | B01J 29/061 208/135 |
| 2009/0177020 | A1* | 7/2009 | Suzuki | C07C 2/84 585/407 |
| 2010/0063340 | A1 | 3/2010 | Takamatsu et al. | |
| 2011/0270004 | A1* | 11/2011 | Yanagawa | B01J 29/061 585/400 |
| 2013/0172639 | A1 | 7/2013 | Yanagawa et al. | |

FOREIGN PATENT DOCUMENTS

| | | | |
|---|---|---|---|
| JP | S53012905 | A | 2/1978 |
| JP | S59179589 | A | 10/1984 |
| JP | H03288548 | A | 12/1991 |
| JP | H08-157399 | A | 6/1996 |
| JP | 2012062356 | A | 3/2012 |
| JP | 2012201797 | A | 10/2012 |
| WO | 2007032448 | A1 | 3/2007 |
| WO | 2012036186 | A1 | 3/2012 |
| WO | 2012133170 | A1 | 10/2012 |

OTHER PUBLICATIONS

Rase, Howard F. Handbook of commercial catalysts: heterogeneous catalysts. CRC press, 2000.*

Shell Western Supply and Trading. (2010). Material Safety Data Sheet. Light Cycle Oil, Version 1.0. Accessed Jul. 27, 2016 at http://www.shell.com/business-customers/trading-and-supply/trading/trading-material-safety-datasheets/_jcr_content/par/expandablelist/expandablesection_1370833703.stream/1447440381065/86111ca68e6317c35ea74fdfad4d4ce0634e18.*

Speight, James G. "Thermal cracking of petroleum." Natural and Laboratory-Simulated Thermal Geochemical Processes. Springer Netherlands, 2003. 31-52.*

Extended Search Report issued on May 20, 2016 in EP Application No. 13849627.8.

International Search Report issued Jan. 28, 2014 in International Application No. PCT/JP2013/079040.

"Petrochemical Process," The Japan Petroleum Institute, Kodansha Ltd., pp. 21-30 (Aug. 10, 2001).

Office Action issued Dec. 20, 2016 in JP Application No. 2014-543372.

Office Action issued Mar. 7, 2017 in JP Application No. 2014-543372.

* cited by examiner

METHOD FOR PRODUCING MONOCYCLIC AROMATIC HYDROCARBON

CROSS-REFERENCE TO RELATED APPLICATION

This application is a Section 371 of International Application No. PCT/JP2013/079040, filed Oct. 25, 2013, which was published in the Japanese language on May 1, 2014, under International Publication No. WO 2014/065419 A1, and the disclosures of which are incorporated herein by reference.

TECHNICAL FIELD

The present invention relates to a method for producing a monocyclic aromatic hydrocarbon and, particularly, to a method for producing a monocyclic aromatic hydrocarbon having 6 to 8 carbon atoms.

Priority is claimed on Japanese Patent Application No. 2012-236134, filed Oct. 25, 2012, the content of which is incorporated herein by reference.

BACKGROUND ART

Oil containing a polycyclic aromatic component such as light cycle oil (hereinafter, abbreviated as "LCO") which is a cracked light oil produced in a fluid catalytic cracking (hereinafter, abbreviated as "FCC") apparatus has so far been used mainly as a light oil or heavy oil-oriented fuel base material. In recent years, a technique has been proposed that efficiently produces a monocyclic aromatic hydrocarbon having 6 to 8 carbon atoms which can be used as a high octane gasoline base material or a petrochemical feedstock and has a high added value (for example, benzene, toluene, or coarse xylene; hereinafter, these will be collectively referred to as "BTX") from a feedstock containing a polycyclic aromatic component.

In addition, as an application of the method for producing BTX from a feedstock containing a polycyclic aromatic component, another method has been proposed for producing an aromatic hydrocarbon in which BTX is produced from a thermally-cracked heavy oil obtained from an apparatus for producing ethylene (for example, refer to PTL 1).

In the method for producing an aromatic hydrocarbon according to PTL 1, compared with the thermally-cracked heavy oil (cracked heavy oil) in the related art which has been mostly used as a fuel or the like for a boiler or the like in industrial complexes, the thermally-cracked heavy oil is hydrogenated, is brought into contact with a catalyst for producing a monocyclic aromatic hydrocarbon, and is reacted, thereby producing BTX.

CITATION LIST

Patent Literature

[PTL 1] Japanese Unexamined Patent Application, First Publication No. 2012-062356

Non-Patent Literature

[NPL 1] "Petrochemical Process" edited by The Japan Petroleum Institute and published by Kodansha Ltd., Aug. 10, 2001, pp. 21 to 30

SUMMARY OF INVENTION

Technical Problem

Both in the technique that produces BTX from LCO and in the technique that produces a BTX fraction from a thermally-cracked heavy oil obtained from an apparatus for producing ethylene as well, there is a desire of a more efficient production of the BTX fraction in order to decrease the production cost of BTX.

In addition, in order to decrease the production cost of BTX, even in apparatuses that carry out the above-described techniques as well, there is a demand for reducing the building cost or operational costs thereof.

The present invention has been made in consideration of the above-described circumstances and an object thereof is to provide a method for producing a monocyclic aromatic hydrocarbon enabling the reduction of the production cost of BTX.

Solution to Problem

As a result of the repetition of thorough studies for achieving the object, the present inventors clarified that, in the past, the use of a fluidized-bed reactor having a high building cost and high operational costs as a cracking and reforming reaction device used to produce BTX using a cracking and reforming reaction hindered the reduction of the production cost of BTX. That is, even though the use of a fixed-bed reactor having a low building cost or low operational costs could reduce the production cost of BTX, the production efficiency of BTX was still decreased due to the deterioration of a catalyst in the fixed-bed reactor and thus the fluidized-bed reactor was used in the past. Therefore, as a result of additional studies based on the above-described finding, the present inventors completed the present invention.

That is, a method for producing a monocyclic aromatic hydrocarbon of the present invention includes a cracking and reforming reaction step of obtaining a product containing a monocyclic aromatic hydrocarbon having 6 to 8 carbon atoms by bringing a feedstock oil having a 10 volume % distillate temperature of 140° C. or higher and a 90 volume % distillate temperature of 390° C. or lower and a saturated hydrocarbon having 1 to 3 carbon atoms into contact with a catalyst for producing a monocyclic aromatic hydrocarbon containing crystalline aluminosilicate, which is loaded into a fixed-bed reactor, and reacting the feedstock oil and the saturated hydrocarbon.

In the production method, the saturated hydrocarbon having 1 to 3 carbon atoms is preferably methane.

In the production method, the feedstock oil is a thermally-cracked heavy oil obtained from an apparatus for producing ethylene and a partially-hydrogenated substance of the thermally-cracked heavy oil.

Alternatively, in the production method, the feedstock oil is a cracked light oil or a partially-hydrogenated substance of the cracked light oil.

In the production method, in the cracking and reforming reaction step, it is preferable that two or more fixed-bed reactors be used and a cracking and reforming reaction and reproduction of the catalyst for producing a monocyclic aromatic hydrocarbon be repeated while the reactors are periodically switched.

In the production method, the crystalline aluminosilicate contained in the catalyst for producing a monocyclic aromatic hydrocarbon used in the cracking and reforming reaction step preferably includes a medium-pore zeolite and/or a large-pore zeolite as a main component.

In addition, in the production method, the catalyst for producing a monocyclic aromatic hydrocarbon used in the cracking and reforming reaction step preferably contains phosphorous.

Advantageous Effects of Invention

According to the method for producing a monocyclic aromatic hydrocarbon of the present invention, it is possible to reduce the production cost of BTX.

DESCRIPTION OF EMBODIMENTS

Figure 1:
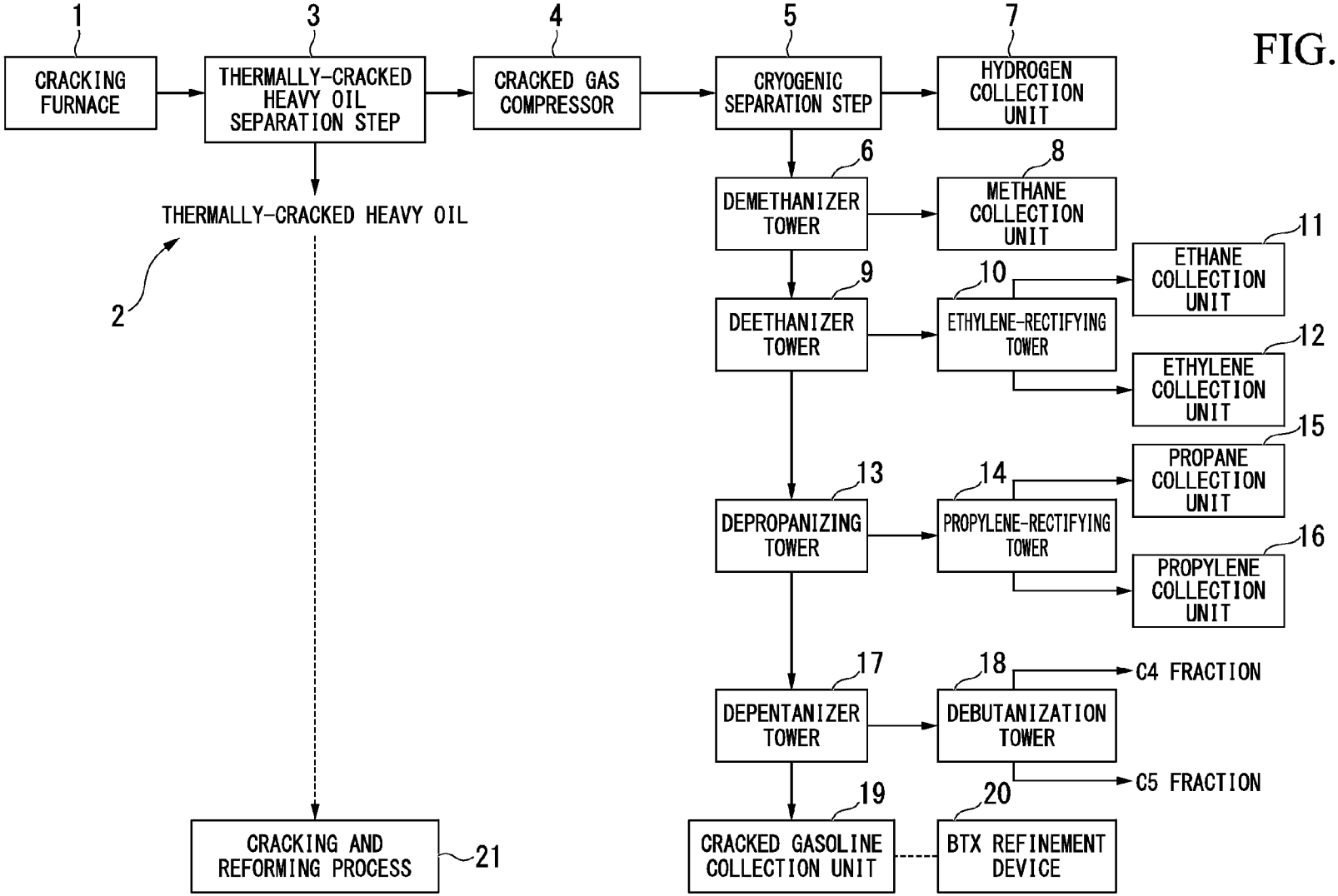
FIG. 1 is a view for illustrating an example of an apparatus for producing ethylene according to an embodiment of the present invention.

A feedstock oil used in the present invention is an oil having a 10 volume % distillate temperature of 140° C. or higher and a 90 volume % distillate temperature of 390° C. or lower. In an oil having a 10 volume % distillate temperature of lower than 140° C., the target monocyclic aromatic hydrocarbon is decomposed and the productivity degrades. In addition, in a case in which an oil having a 90 volume % distillate temperature of higher than 390° C. is used, the yield of a monocyclic aromatic hydrocarbon is decreased and thus there is a tendency that the amount of coke accumulated on a catalyst for producing a monocyclic aromatic hydrocarbon increases and an abrupt degradation of the catalyst activity is caused. The 10 volume % distillate temperature of the feedstock oil is preferably 150° C. or higher and the 90 volume % distillate temperature of the feedstock is preferably 360° C. or lower. The 10 volume % distillate temperature and the 90 volume % distillate temperature refer to values measured according to JIS K 2254 "Testing Method For Distillation Of Petroleum Products".

Examples of the feedstock oil having a 10 volume % distillate temperature of 140° C. or higher and a 90 volume % distillate temperature of 390° C. or lower include a thermally-cracked heavy oil obtained from an apparatus for producing ethylene, a hydrocarbon of the thermally-cracked heavy oil obtained from the apparatus for producing ethylene, a cracked light oil (LCO) produced using a fluid catalytic cracking apparatus, hydrorefined oil of LCO, coal liquefaction oil, heavy oil hydrogenolysis refined oil, distilled kerosene, distilled light oil, coker kerosene, coker light oil, oil sand hydrogenolysis refined oil, and the like.

The thermally-cracked heavy oil obtained from the apparatus for producing ethylene is a fraction heavier than a BTX fraction obtained from the apparatus for producing ethylene and contains a large amount of an aromatic hydrocarbon. In addition, a cracked light oil (LCO) produced using a fluid catalytic cracking apparatus and the like also contain a large amount of an aromatic hydrocarbon. In a case in which, out of fractions containing a large amount of an aromatic hydrocarbon, a fraction containing a large amount of a polycyclic aromatic is used, the fraction causes the generation of coke in the following cracking and reforming reaction and thus it is desirable to carry out a hydrogenation treatment. Even for the thermally-cracked heavy oil or fractions derived from LCO, when the fraction contains a large amount of a monocyclic aromatic hydrocarbon, it is not always required to carry out the hydrogenation treatment. Even for other feedstock oils, the feedstock oils are selected with, basically, the same way of thinking and it is desirable to avoid feedstock oils from which coke is excessively generated in the cracking and reforming reaction.

The polycyclic aromatic hydrocarbon is a substance which has a low reactivity and is not easily converted to a monocyclic aromatic hydrocarbon in the cracking and reforming reaction of the present invention. However, conversely, when hydrogenated with a hydrogenation reaction, the polycyclic aromatic hydrocarbon is converted to naphthenobenzene and then, when supplied to the cracking and reforming reaction, the polycyclic aromatic hydrocarbon can be converted to a monocyclic aromatic hydrocarbon. However, among polycyclic aromatic hydrocarbons, tricyclic or higher aromatic hydrocarbons consume a large amount of hydrogen in the hydrogenation reaction step and have a low reactivity in the cracking and reforming reaction in spite of being hydrogenation reactants and thus containing a large amount of tricyclic or higher aromatic hydrocarbons is not preferred. Therefore, the content of the tricyclic or higher aromatic hydrocarbon in the feedstock oil is preferably 25% by volume or less and more preferably 15% by volume or less.

The polycyclic aromatic component mentioned herein refers to a total value of the content of a bicyclic aromatic hydrocarbon (bicyclic aromatic component) and the content of a tricyclic or higher aromatic hydrocarbon (tricyclic or higher aromatic component) which are measured according to JPI-5S-49 "Hydrocarbon Type Testing Method for Petroleum Products using High Performance Liquid Chromatography" or are analyzed using an FID gas chromatograph method or a two-dimensional gas chromatograph method. Hereinafter, in a case in which the content of the polycyclic aromatic hydrocarbon, the bicyclic aromatic hydrocarbon, or the tricyclic or higher aromatic hydrocarbon is expressed using % by volume, the content is a value measured according to JP1-5S-49 and, in a case in which the content is expressed using % by mass, the content is a value measured on the basis of the FID gas chromatograph method or the two-dimensional gas chromatograph method.

(Hydrogenation Treatment of Feedstock Oil)

In a case in which the feedstock oil has been hydrogenated in advance, the hydrogenation reaction is desirably caused in accordance with instructions described below. In the hydrogenation reaction, the hydrogenated feedstock oil is partially hydrogenated instead of being fully hydrogenated. That is, mainly bicyclic aromatic hydrocarbon in the feedstock oil is selectively hydrogenated and is converted to a monocyclic aromatic hydrocarbon (naphthenobenzene or the like) in which only one aromatic ring is hydrogenated. Here, examples of the monocyclic aromatic hydrocarbon include indane, tetralin, alkylbenzene, and the like.

When the feedstock oil is partially hydrogenated as described above, the amount of hydrogen consumed in the hydrogenation reaction step is suppressed and, simultaneously, the amount of heat generated during the treatment can also be suppressed. For example, when naphthalene, which is a typical example of the bicyclic aromatic hydrocarbon, is hydrogenated to decalin, the amount of hydrogen consumed per mole of naphthalene reaches 5 moles; however, in a case in which naphthalene is hydrogenated to tetralin, naphthalene can be hydrogenated with an amount of hydrogen consumed of 2 moles. In addition, in the case of a fraction including an indene skeleton in the feedstock oil, the fraction needs to be hydrogenated until the indene skeleton is hydrogenated.

As the hydrogen used in the hydrogenation reaction, hydrogen generated from the cracking and reforming reaction in the present application can be used.

The above-described hydrogenation treatment can be carried out using a well-known hydrogenation reactor. In the hydrogenation reaction, the hydrogen partial pressure at the reactor inlet is preferably in a range of 1 MPa to 9 MPa. The lower limit is more preferably 1.2 MPa or more and still more preferably 1.5 MPa or more. In addition, the upper limit is more preferably 7 MPa or less and still more preferably 5 MPa or less. In a case in which the hydrogen partial pressure is less than 1 MPa, coke is vigorously generated on the catalyst and the catalyst life becomes short. On the other hand, in a case in which the hydrogen partial pressure exceeds 9 MPa, more bicyclic aromatic hydrocarbons are fully hydrogenated so that both rings in the hydrocarbon are hydrogenated and the amount of hydrogen consumed significantly increases and thus there is a concern that the economic efficiency may be impaired due to a decrease in the yield of the monocyclic aromatic hydrocarbon and an increase in the building costs for the hydrogenation reactor or peripheral equipment.

The liquid hourly space velocity (LHSV) of the hydrogenation reaction is preferably in a range of 0.05 $h^{-1}$ to 10 $h^{-1}$. The lower limit is more preferably 0.1 $h^{-1}$ or more and still more preferably 0.2 $h^{-1}$ or more. In addition, the upper limit is more preferably 5 $h^{-1}$ or less and more preferably 3 or less. In a case in which the LHSV is less than $0.05^{-1}$, the building cost of the reactor becomes excessive and there is a concern that the economic efficiency may be impaired. On the other hand, in a case in which the LHSV exceeds 10 $h^{-1}$, the hydrogenation treatment of the feedstock oil does not sufficiently proceed and there is a possibility that the target hydride may not be obtained.

The reaction temperature (hydrogenation temperature) in the hydrogenation reaction is preferably in a range of 150° C. to 400° C. The lower limit is more preferably 170° C. or higher and still more preferably 190° C. or higher. In addition, the upper limit is more preferably 380° C. or lower and still more preferably 370° C. or lower. In a case in which the reaction temperature is below 150° C., there is a tendency that the feedstock oil is not sufficiently hydrogenated. On the other hand, in a case in which the reaction temperature exceeds 400° C., the generation of a gas component, which is a byproduct, increases and thus the yield of a hydrogenated oil decreases, which is not desirable.

The hydrogen/oil ratio in the hydrogenation reaction is preferably in a range of 100 NL/L to 2000 NL/L. The lower limit is more preferably 110 NL/L or more and still more preferably 120 NL/L or more. In addition, the upper limit is more preferably 1800 NL/L or less and still more preferably 1500 NL/L or less. In a case in which the hydrogen/oil ratio is less than 100 NL/L, the generation of coke on the catalyst in the reactor outlet proceeds and there is a tendency that the catalyst life becomes short. On the other hand, in a case in which the hydrogen/oil ratio exceeds 2000 NL/L, the building cost of a recycling compressor becomes excessive and there is a concern that the economic efficiency may be impaired.

There is no particular limitation regarding the reaction format in the hydrogenation treatment. Generally, the reaction format can be selected from a variety of processes such as a fixed bed and a movable bed and, among them, the fixed bed is preferred since the building cost or the operational costs are inexpensive. In addition, the hydrogenation reaction device preferably has a tower shape.

A catalyst for the hydrogenation treatment which is used for the hydrogenation treatment is not limited as long as the catalyst is capable of selectively hydrogenating and converting bicyclic aromatic hydrocarbons in the feedstock oil to monocyclic aromatic hydrocarbons (naphthenobenzenes or the like) in which only one aromatic ring is hydrogenated. A preferable catalyst for the hydrogenation treatment contains at least one metal selected from Group 6 metals in the periodic table and at least one metal selected from Groups 8 to 10 metals in the periodic table. The Group 6 metal in the periodic table is preferably molybdenum, tungsten, or chromium and particularly preferably molybdenum or tungsten. The Groups 8 to 10 metal is preferably iron, cobalt, or nickel and more preferably cobalt or nickel. These metals may be singly used or a combination of two or more metals may be used. Specific examples of the combination that is preferably used include molybdenum-cobalt, molybdenum-nickel, tungsten-nickel, molybdenum-cobalt-nickel, tungsten-cobalt-nickel, and the like. The periodic table refers to the extended periodic table specified by the International Union of Pure and Applied Chemistry (IUPAC).

The catalyst for the hydrogenation treatment is preferably a catalyst obtained by supporting the above-described metals in an inorganic carrier containing aluminum oxide. Preferable examples of the inorganic carrier containing aluminum oxide include carriers obtained by adding a porous inorganic compound such as a variety of clay minerals such as alumina, alumina-silica, alumina-boria, alumina-titania, alumina-zirconia, alumina-magnesia, alumina-silica-zirconia, alumina-silica-titania, a variety of zeolites, sebiolite, and montmorillonite to alumina and, among them, alumina is particularly preferred. The inorganic carrier made of a plurality of metal oxides such as alumina-silica described above may be a pure mixture of those oxides or a composite oxide.

The catalyst for the hydrogenation treatment is preferably a catalyst obtained by supporting at least one metal selected from Group 6 metals in the periodic table in a range of 10% by mass to 30% by mass and at least one metal selected from Groups 8 to 10 metals in the periodic table in a range of 1% by mass to 7% by mass in an inorganic carrier containing aluminum oxide in relation to the total catalyst mass which is the total mass of the inorganic carrier and the metals. In a case in which the support amount of the Group 6 metals in the periodic table and the support amount of the Groups 8 to 10 metals in the periodic table are less than the respective lower limits, there is a tendency that the catalyst does not exhibit sufficient hydrogenation treatment activity and, on the other hand, in a case in which the support amounts exceed the respective upper limits, the catalyst cost increases, the supported metals are likely to be agglomerated or the like, and there is a tendency that the catalyst does not exhibit sufficient hydrogenation treatment activity.

There is no particular limitation regarding the precursor of the metallic species used to support the metals in the inorganic carrier, the inorganic salts, organic metal compounds, or the like of the metals are used, and water-soluble inorganic salts are preferably used. In a supporting step, the metals are supported in the inorganic carrier using a solution, preferably an aqueous solution, of the metal precursor. As a supporting operation, for example, a well-known method such as an immersion method, an impregnation method, or a co-precipitation method is preferably employed.

It is preferable that the carrier in which the metal precursor is supported be fired after being dried, preferably in the presence of oxygen, and the metallic species is, first, made to form an oxide. Furthermore, it is preferable, before the hydrogenation treatment of the feedstock oil, to form a sulfide with the metal species through a sulfurization treatment called preliminary sulfurization.

There is no particular limitation regarding the conditions of the preliminary sulfurization, but it is preferable that a sulfur compound be added to a petroleum fraction or a thermally-cracked heavy oil (hereinafter, referred to as the preliminary sulfurization feedstock oil) and the compound be continuously brought into contact with the catalyst for the hydrogenation treatment under conditions of a temperature in a range of 200° C. to 380° C., LHSV in a range of 1 $h^{-1}$ to 2 $h^{-1}$, a pressure applied at the same time as the operation of the hydrogenation treatment, and a treatment time of 48 hours or longer. The sulfur compound added to the preliminary sulfurization feedstock oil is not particularly limited and is preferably dimethyl disulfide (DMDS), sulfazole, hydrogen sulfide, or the like, and approximately 1% by mass of the sulfur compound in terms of the mass of the preliminary sulfurization feedstock oil is preferably added to the preliminary sulfurization feedstock oil.

[Cracking and Reforming Reaction]

In the cracking and reforming reaction, the supplied feedstock oil (containing the hydrogenated oil) is brought into contact with the catalyst for producing a monocyclic aromatic hydrocarbon, the feedstock oil and the catalyst are reacted together, and a product containing a monocyclic aromatic hydrocarbon having 6 to 8 carbon atoms is obtained.

[Catalyst for Producing Monocyclic Aromatic Hydrocarbon]

The catalyst for producing a monocyclic aromatic hydrocarbon contains crystalline aluminosilicate. The content of the crystalline aluminosilicate in the catalyst may be determined depending on the reactivity or selectivity of a required cracking and reforming reaction or the shape and strength of the catalyst and is not particularly limited, but is preferably in a range of 10% by mass to 100% by mass. The catalyst is used in a fixed-bed reactor and thus may be a catalyst only made of the crystalline aluminosilicate. When a binder is added in order to increase the strength, the content of the crystalline aluminosilicate is preferably in a range of 20% by mass to 95% by mass and more preferably in a range of 25% by mass to 90% by mass. However, when the content of the crystalline aluminosilicate is below 10%, the amount of the catalyst necessary to obtain sufficient catalytic activity becomes excessive, which is not preferable.

[Crystalline Aluminosilicate]

The crystalline aluminosilicate preferably includes a medium-pore zeolite and/or a large-pore zeolite as a main component since the yield of a monocyclic aromatic hydrocarbon can be further increased.

The medium-pore zeolite is a zeolite having a 10-membered ring skeleton structure and examples of the medium-pore zeolite include zeolites having an AEL-type, EUO-type, FER-type, HEU-type, MEL-type, MFI-type, NES-type, TON-type, or WEI-type crystal structure. Among them, since the yield of a monocyclic aromatic hydrocarbon can be further increased, a zeolite having the MFI-type crystal structure is preferred.

The large-pore zeolite is a zeolite having a 12-membered ring skeleton structure and examples of the large-pore zeolite include zeolites having an AFT-type, ATO-type, BEA-type, CON-type, FAU-type, GME-type, LTL-type, MOR-type, MTW-type, or OFF-type crystal structure. Among them, zeolites having the BEA-type, FAU-type, or MOR-type crystal structure are preferred since they can be industrially used and a zeolite having the BEA-type crystal structure is preferred since the yield of a monocyclic aromatic hydrocarbon can be further increased.

In addition to the medium-pore zeolite and/or the large-pore zeolite, the crystalline aluminosilicate may contain a small-pore zeolite having a 10 or less-membered ring skeleton structure and an ultralarge-pore zeolite having a 14 or more-membered skeleton structure.

Here, examples of the small-pore zeolite include zeolites having an ANA-type, CHA-type, ERI-type, GIS-type, KFI-type, LTA-type, NAT-type, PAU-type, and YUG-type crystal structure.

Examples of the ultralarge-pore zeolite include zeolites having a CLO-type or VPI-type crystal structure.

In addition, in the crystalline aluminosilicate, the molar ratio (Si/Al ratio) of silicon to aluminum is 100 or less and preferably 50 or less. When the Si/Al ratio of the crystalline aluminosilicate exceeds 100, the yield of a monocyclic aromatic hydrocarbon becomes low.

In addition, the Si/Al ratio of the crystalline aluminosilicate is preferably 10 or more in order to obtain a sufficient yield of a monocyclic aromatic hydrocarbon.

The catalyst for producing a monocyclic aromatic hydrocarbon according to the present invention may further contain potassium and/or zinc. When the catalyst contains potassium and/or zinc, a more efficient BTX production can be expected.

Examples of the crystalline aluminosilicate containing potassium and/or zinc include crystalline aluminosilicate having gallium incorporated into the lattice skeleton (crystalline aluminogallosilicate), crystalline aluminosilicate having zinc incorporated into the lattice skeleton (crystalline aluminozincosilicate), crystalline aluminosilicate having gallium supported therein (Ga-supported crystalline aluminosilicate), crystalline aluminosilicate having zinc supported therein (Zn-supported crystalline aluminosilicate), and crystalline aluminosilicate containing at least one thereof.

The Ga-supported crystalline aluminosilicate and/or the Zn-supported crystalline aluminosilicate are crystalline aluminosilicates in which gallium and/or zinc are supported using a well-known method such as an ion exchange method or an impregnation method. There is no particular limitation regarding a gallium source and a zinc source used at this time and examples thereof include gallium salts such as gallium nitrate and gallium chloride, zinc salts such as gallium oxide, zinc nitrate, and zinc chloride, zinc oxide, and the like.

The upper limit of the content of gallium and/or zinc in the catalyst is preferably 5% by mass or less, more preferably 3% by mass or less, still more preferably 2% by mass or less, and still more preferably 1% by mass or less in a case in which the total amount of the catalyst is considered as 100% by mass. When the content of gallium and/or zinc exceeds 5% by mass, the yield of a monocyclic aromatic hydrocarbon becomes low, which is not preferable.

In addition, the lower limit of the content of gallium and/or zinc is preferably 0.01% by mass or more and more preferably 0.1% by mass or more in a case in which the total amount of the catalyst is considered as 100% by mass. When the content of gallium and/or zinc is less than 0.01% by mass, the yield of a monocyclic aromatic hydrocarbon becomes low, which is not preferable.

The crystalline aluminogallosilicate and/or the crystalline aluminozincosilicate are crystalline aluminosilicates having a structure in which the $SiO_4$, $AlO_4$, and $GaO_4/ZnO_4$ structure is tetrahedrally coordinated in the skeleton and can be obtained using gel crystallization through hydrothermal synthesis, a method in which gallium and/or zinc are inserted into the lattice skeleton of the crystalline aluminosilicate, or a method in which aluminum is inserted into the lattice skeleton of the crystalline gallosilicate and/or the crystalline zincosilicate.

The catalyst for producing a monocyclic aromatic hydrocarbon preferably contains phosphorous. The content of phosphorous in the catalyst is preferably in a range of 0.1% by mass to 10.0% by mass in a case in which the total amount of the catalyst is considered as 100% by mass. The lower limit of the content of phosphorous is preferably 0.1% by mass or more and more preferably 0.2% by mass or more since a decrease in the yield of a monocyclic aromatic hydrocarbon over time can be prevented. On the other hand, the upper limit of the content of phosphorous is preferably 10.0% by mass or less, more preferably 6.0% by mass or less, and still more preferably 3.0% by mass or less since the yield of a monocyclic aromatic hydrocarbon can be increased.

There is no particular limitation regarding the method for adding phosphorous to the catalyst for producing a monocyclic aromatic hydrocarbon and examples thereof include a method in which phosphorous is supported in the crystalline aluminosilicate, the crystalline aluminogallosilicate, or the crystalline aluminozincosilicate using an ion exchange method, an impregnation method, or the like, a method in which a phosphorous compound is added during the synthesis of a zeolite so as to substitute a part of the inside of the skeleton of the crystalline aluminosilicate with phosphorous, a method in which a phosphorous-containing crystal accelerator is used during the synthesis of a zeolite, and the like. An aqueous solution containing phosphoric acid ions which is used during the addition of phosphorous is not particularly limited and an aqueous solution prepared by dissolving phosphoric acid, diammonium hydrogen phosphate, ammonium dihydrogen phosphate, and other water-soluble phosphate, or the like in water at an arbitrary concentration can be preferably used.

The catalyst for producing a monocyclic aromatic hydrocarbon can be formed by firing phosphorous-supported crystalline aluminogallosilicate/crystalline aluminozincosilicate, or gallium/zinc and phosphorous-supported crystalline aluminosilicate (at a firing temperature in a range of 300° C. to 900° C.) as described above.

In addition, the catalyst for producing a monocyclic aromatic hydrocarbon is formed in a powder form, a granular form, a pellet form, or the like depending on the reaction format in the cracking and reforming reaction device. In the present invention, a fixed-bed reactor is used, and the catalyst having a granular form or a pellet form is used.

In a case in which a granular-form or pellet-form catalyst is obtained, it is possible to blend an inactive oxide with the catalyst as a binder as necessary and then shape the catalyst using a variety of shaping devices. For catalysts used in the above-described fixed-bed reactor, an inorganic substance such as silica or alumina is preferably used as the binder.

In a case in which the catalyst for producing a monocyclic aromatic hydrocarbon contains a binder or the like, a substance containing phosphorous may be used as the binder as long as the content of phosphorous is in the above-described preferable range.

In addition, in a case in which the catalyst for producing a monocyclic aromatic hydrocarbon contains a binder, it is also possible to mix the binder and the gallium and/or zinc-supported crystalline aluminosilicate or mix the binder and the crystalline aluminogallosilicate and/or crystalline aluminozincosilicate and then add phosphorous, thereby producing a catalyst.

[Reaction Format]

As a reaction format of the cracking and reforming reaction, in the present invention, a fixed bed can be used as described above.

The fixed bed has an apparatus coat that is extremely inexpensive compared with a fluidized bed or a movable bed. That is, the fixed bed has a building cost or operational costs that are inexpensive compared with the fluidized bed or the movable bed. Therefore, while it is still possible to repeat the reaction and production with one fixed-bed reactor, in order to continuously carry out the reaction and reproduction, two or more reactors can be installed.

In the fixed-bed cracking and reforming reaction device, as the cracking and reforming reaction proceeds, coke is attached to the catalyst surface and the activity of the catalyst degrades. When the activity degrades as described above, in the cracking and reforming reaction step, while the yield of an olefin having 2 to 4 carbon atoms increases, the yield of a monocyclic aromatic hydrocarbon having 6 to 8 carbon atoms (BTX fraction) decreases and the total amount of the olefin having 2 to 4 carbon atoms and the monocyclic aromatic hydrocarbon having 6 to 8 carbon atoms decreases. Therefore, the reproduction treatment of the catalyst becomes necessary.

[Reaction Temperature]

The reaction temperature when the feedstock oil is brought into contact with and is reacted with the catalyst is not particularly limited, but is preferably in a range of 350° C. to 700° C. and more preferably in a range of 400° C. to 650° C. When the reaction temperature is lower than 350° C., the reaction activity is not sufficient. When the reaction temperature exceeds 700° C., the reaction becomes disadvantageous in terms of energy and the amount of coke generated is significantly increased and thus the production efficiency of the target substance is decreased.

[Reaction Pressure]

The reaction pressure when the feedstock oil is brought into contact with and is reacted with the catalyst is in a range of 0.1 MPaG to 2.0 MPaG. That is, the feedstock oil is brought into contact with the catalyst for producing a monocyclic aromatic hydrocarbon at a pressure in a range of 0.1 MPaG to 2.0 MPaG.

In the present invention, since the reaction concept is completely different from that of a method of the related art in which hydrogenolysis is used, a condition of high pressure, which is preferred in hydrogenolysis, is not required. Conversely, a pressure higher than necessary accelerates cracking and produces unintended light gas as a byproduct, which is not preferable. In addition, the non-necessity of the high-pressure condition is also preferred in terms of the design of the reaction apparatus. That is, when the reaction pressure is in a range of 0.1 MPaG to 2.0 MPaG, it is possible to efficiently cause a hydrogen transfer reaction.

[Contact Time]

The contact time between the feedstock oil and the catalyst is not particularly limited as long as a desired reaction substantially proceeds and, for example, the gas passing time over the catalyst is preferably in a range of 2 seconds to 150 seconds, more preferably in a range of 3 seconds to 100 seconds, and still more preferably in a range of 5 seconds to 80 seconds. When the contact time is shorter than 2 seconds, a substantial reaction is difficult. When the contact time exceeds 150 seconds, the amount of a carbonaceous material accumulated on the catalyst due to coking or the like increases or the amount of light gas generated by cracking increases and, furthermore, the size of the device is also increased, which is not preferable.

[Reproduction Treatment]

Once a cracking and reforming reaction treatment is carried out for a predetermined time, the cracking and reforming reaction treatment is operated using the other cracking and reforming reaction device and, in the cracking and reforming reaction device stopped to be used for the cracking and reforming reaction treatment, the reproduction of the catalyst for producing a monocyclic aromatic hydrocarbon having the degraded activity can be carried out. In order to continuously cause the reaction, two or more reactors may be installed or it is also possible to repeat the reaction and reproduction with a single reactor.

Since the catalyst degradation of the catalyst is mainly caused by the attachment of coke to the catalyst surface, as the reproduction treatment, a treatment to remove coke from the catalyst surface is carried out. Specifically, air is circulated in the cracking and reforming reaction device and coke attached to the catalyst surface is combusted. Since the cracking and reforming reaction device is maintained at a sufficiently high temperature, the coke attached to the catalyst surface is easily combusted simply by circulating air. However, when ordinary air is supplied and circulated in the cracking and reforming reaction device, there is a concern of abrupt combustion. Therefore, it is preferable to supply and circulate air having an oxygen concentration decreased by interfusing nitrogen in advance to the cracking and reforming reaction device. That is, as the air used in the reproduction treatment, for example, air having an oxygen concentration decreased in a range of approximately several % to 10% is preferably used. In addition, it is not necessary to equal the reaction temperature and the reproduction temperature and preferred temperatures can be appropriately set.

[Dilution Treatment]

In the present invention, in the cracking and reforming reaction treatment in the cracking and reforming reaction device, in order to suppress the attachment of coke to the catalyst surface, the feedstock oil is treated in a state in which a saturated hydrocarbon having 1 to 3 carbon atoms, for example, methane, coexist. Methane is almost unreactive and thus, even when methane is brought into contact with the catalyst in the cracking and reforming reaction device, a reaction is not caused. Therefore, for the attachment of a heavy hydrocarbon derived from the feedstock oil to the catalyst surface occurring while the catalyst reaction proceeds, the methane acts as a diluting agent that decreases the concentration of the hydrocarbon on the catalyst surface and thus suppresses (hinders) the attachment. Therefore, the methane suppresses the heavy hydrocarbon derived from the feedstock oil being attached to the catalyst surface so as to become coke. In the present application, regarding the coexistence of the feedstock oil and the saturated hydrocarbon having 1 to 3 carbon atoms, there is no particular limitation regarding the method or configuration of the apparatus therefor as long as both components are introduced into the reactor in a mixture form. Both components are preferably sufficiently mixed since being diluted.

Figure 2:
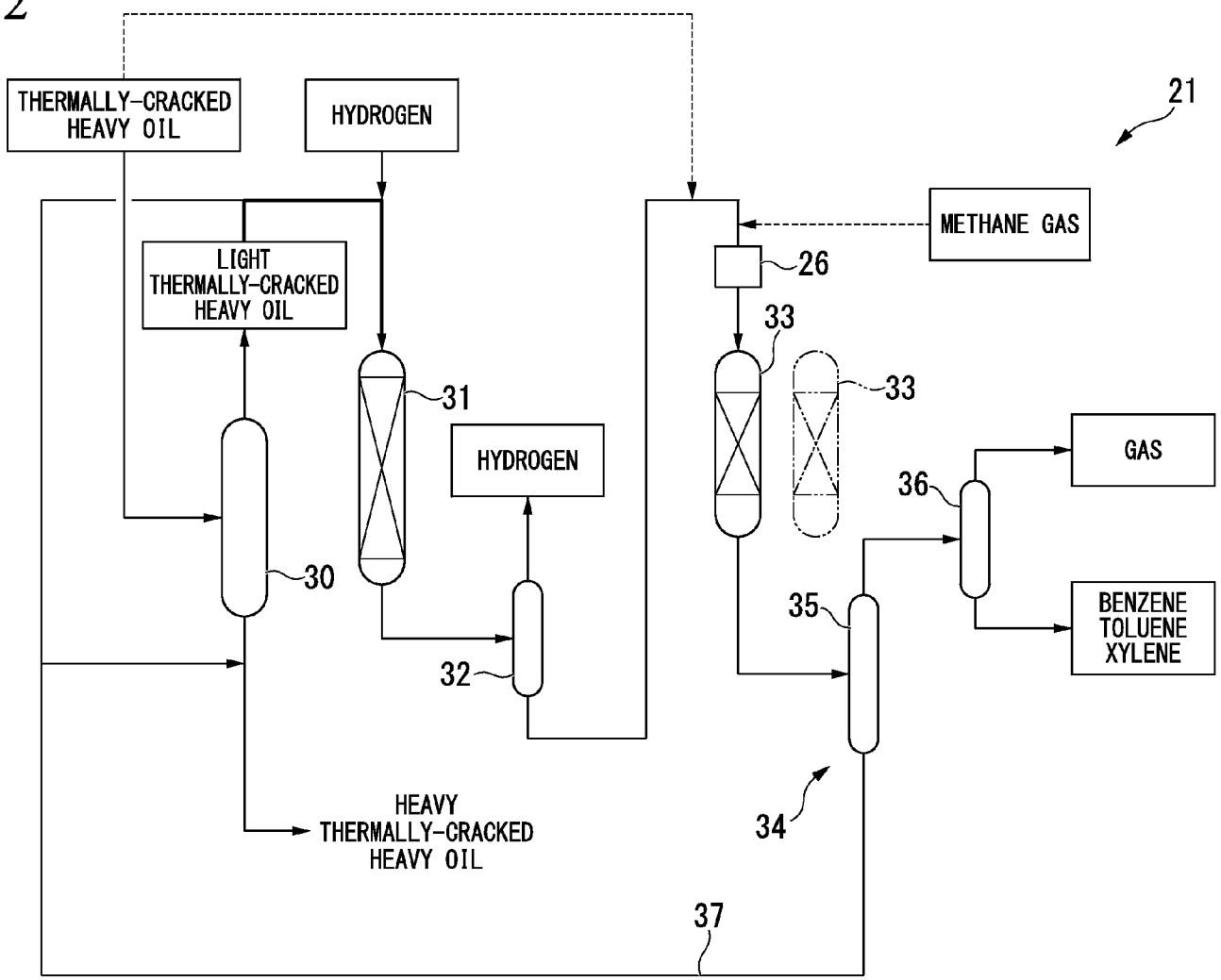
FIG. 2 is a view for illustrating a cracking and reforming process of the present application in a case in which the apparatus for producing ethylene illustrated in FIG. 1 is used.

There is no particular limitation regarding the saturated hydrocarbon having 1 to 3 carbon atoms which is provided to the cracking and reforming reaction device and it is possible to use saturated hydrocarbons that can be easily procured, for example, in a case in which the thermally-cracked heavy oil from the apparatus for producing ethylene is used as the feedstock oil, methane produced form the same ethylene apparatus and, in a case in which LCO is used as the feedstock oil, off-gas obtained from the fluid catalytic cracking apparatus. In this case, for example, methane gas may be heated to a predetermined temperature in the heating furnace 26 as illustrated in FIG. 2. In addition, it is also possible to collect and use methane produced from the cracking and reforming reaction. As described above, as the saturated hydrocarbon having 1 to 3 carbon atoms, methane having the lowest reactivity is preferred, but it is also possible to use ethane or propane instead of methane. Other saturated hydrocarbons having 2 or 3 carbon atoms may be jointly used with methane and it is still possible to carry other saturated hydrocarbon gases or the like as long as the gas or the like includes the above-described saturated hydrocarbon as a main component.

The ratio of the saturated hydrocarbon having 1 to 3 carbon atoms/oil in the cracking and reforming reaction is preferably in a range of 20 NL/L to 2000 NL/L. The lower limit is more preferably 30 NL/L or more and still more preferably 50 NL/L or more. In addition, the upper limit is more preferably 1800 NL/L or less and still more preferably 1500 NL/L or less. In a case in which the ratio of the saturated hydrocarbon having 1 to 3 carbon atoms/oil is less than 20 NL/L, the dilution effect is insufficient and it becomes impossible to sufficiently suppress the attachment of coke to the catalyst surface. On the other hand, in a case in which the ratio of the saturated hydrocarbon having 1 to 3 carbon atoms/oil exceeds 2000 NL/L, the size of the cracking and reforming reaction device is increased and thus the building cost thereof increases and a decrease in the production cost of an olefin or BTX is impaired.

Hereinafter, an embodiment of a case in which a thermally-cracked heavy oil from the apparatus for producing ethylene is used as the feedstock oil will be described in detail as an example with reference to the accompanying drawings. FIG. 1 is a view for illustrating an example of the apparatus for producing ethylene used to carry out the method for producing a monocyclic aromatic hydrocarbon having 6 to 8 carbon atoms of the present invention and FIG. 2 is a view for illustrating the cracking and reforming process of the apparatus for producing ethylene illustrated in FIG. 1.

First, the schematic configuration of an example of the apparatus for producing ethylene according to the present invention and a process according to the production method of the present invention will be described with reference to FIG. 1.

In the embodiment of the apparatus for producing ethylene according to the present invention, parts other than the cracking and reforming process illustrated in FIG. 2 may be a well-known apparatus for producing ethylene including a cracking step and a separation and refinement step. Therefore, an apparatus produced by adding the cracking and reforming process of the present invention to the existing apparatus for producing ethylene is also included in the scope of the embodiment of the apparatus for producing ethylene according to the present invention. Examples of the well-known apparatus for producing ethylene include the apparatus described in NPL 1.

The apparatus for producing ethylene according to the present embodiment is also called a steam cracker, a steam cracking device, or the like and, as illustrated in FIG. 1, includes a cracking furnace 1 and a product collection device 2 that separates and collects hydrogen, ethylene, propylene, a C4 fraction, and a fraction containing a monocyclic aromatic hydrocarbon having 6 to 8 carbon atoms (BTX fraction: cracked gasoline) respectively from a cracked product produced in the cracking furnace 1.

The cracking furnace 1 thermally cracks feedstocks such as a naphtha fraction, a kerosene fraction, and a light fraction, produces hydrogen, ethylene, propylene, a C4 fraction, and the BTX fraction, and produces a thermally-cracked heavy oil as a residual oil (bottom oil) heavier than the BTX fraction. The thermally-cracked heavy oil is also called a heavy aromatic residue oil (HAR oil) in some cases. The operation conditions of the cracking furnace 1 are not particularly limited and the cracking furnace can be operated under ordinary conditions. For example, diluted water vapor is used as a feedstock and the cracking furnace is operated at a thermal cracking reaction temperature in a range of 770° C. to 850° C. and a retention time (reaction time) in a range of 0.1 seconds to 0.5 seconds. When the thermal cracking temperature is lower than 770° C., cracking does not proceed and a target product cannot be obtained and thus the lower limit of the thermal cracking reaction temperature is more preferably 775° C. or higher and still more preferably 780° C. or higher. On the other hand, when the thermal cracking temperature exceeds 850° C., the amount of gas generated abruptly increases, thus, hindrance is caused in the operation of the cracking furnace 1, and thus the upper limit of the thermal cracking reaction temperature is more preferably 845° C. or lower and still more preferably 840° C. or lower. The steam/feedstock (mass ratio) is desirably in a range of 0.2 to 0.9, more desirably in a range of 0.25 to 0.8, and still more desirably in a range of 0.3 to 0.7. The retention time (reaction time) of the feedstock is more desirably in a range of 0.15 seconds to 0.45 seconds and still more desirably in a range of 0.2 seconds to 0.4 seconds.

The product collection device 2 includes a thermally-cracked heavy oil separation step 3 and further includes individual collection units that separate and collect hydrogen, ethylene, propylene, a C4 fraction, and a fraction containing a monocyclic aromatic hydrocarbon having 6 to 8 carbon atoms (BTX fraction: cracked gasoline) respectively.

The thermally-cracked heavy oil separation step 3 is a distillation tower that separates a cracked product obtained in the cracking furnace 1 into a component having a higher boiling point and a component having a lower boiling point on the basis of a specific boiling point before the beginning of main distillation. The lower boiling point component separated in the thermally-cracked heavy oil separation step 3 is extracted in a gas form and is pressurized using a cracked gas compressor 4. The specific boiling point is set so that the target products of the apparatus for producing ethylene, that is, hydrogen, ethylene, propylene, furthermore, a C4 fraction, and cracked gasoline (BTX fraction), are mainly included in the lower boiling point component.

In addition, the higher boiling point component (bottom fraction) separated in the thermally-cracked heavy oil separation step 3 becomes the thermally-cracked heavy oil and may be further separated as necessary. For example, a gasoline fraction, a light thermally-cracked heavy oil, a heavy thermally-cracked heavy oil, and the like can be separated and collected using the distillation tower or the like.

Gas (cracked gas) that has been separated in the thermally-cracked heavy oil separation step 3 and has been pressurized using the cracked gas compressor 4 is separated into hydrogen and a component having a higher boiling point than hydrogen in a cryogenic separation step 5 after washing or the like. Next, the component heavier than hydrogen is supplied to a demethanizer tower 6 and methane is separated and collected. In addition to the above-described configuration, a hydrogen collection unit 7 and a methane collection unit 8 are formed on the downstream side of the cryogenic separation step 5. The collected hydrogen and methane are both used in a new process described below.

The higher boiling point component separated in the demethanizer tower 6 is supplied to a deethanizer tower 9. Ethylene, ethane, and a component having a higher boiling point than ethylene and ethane are separated in the deethanizer tower 9. The ethylene and ethane separated in the deethanizer tower 9 are separated into ethylene and ethane using an ethylene-rectifying tower 10 and the ethylene and ethane are collected respectively. In addition to the above-described configuration, an ethane collection unit 11 and an ethylene collection unit 12 are formed on the downstream side of the ethylene-rectifying tower 10. The collected ethylene becomes a main product that is produced using the apparatus for producing ethylene. In addition, the collected ethane can also be supplied to the cracking furnace 1 together with the feedstocks such as a naphtha fraction, a kerosene fraction, and a light fraction and be recycled.

The higher boiling point component separated in the deethanizer tower 9 is supplied to a depropanizing tower 13. In addition, propylene, propane, and a component having a higher boiling point than propylene and propane are separated in the depropanizing tower 13. From the propylene and propane separated in the depropanizing tower 13, the propylene is rectified and separated using a propylene-rectifying tower 14 and is collected. In addition to the above-described configuration, a propane collection unit 15 and a propylene collection unit 16 are formed on the downstream side of the propylene-rectifying tower 14. The collected propylene also becomes a main product that is produced using the apparatus for producing ethylene.

The higher boiling point component separated in the depropanizing tower 13 is supplied to a depentanizer tower 17. In addition, a component having 5 or less carbon atoms and a component having a higher boiling point than the above-described component, that is, a component having 6 or more carbon atoms, are separated in the depentanizer tower 17. The component having 5 or less carbon atoms separated in the depentanizer tower 17 is separated into a C4 fraction mainly made of a component having 4 carbon atoms and a C5 fraction mainly made of a component having 5 carbon atoms in a debutanization tower 18 and the fractions are collected respectively. The component having 4 carbon atoms separated in the debutanization tower 18 can also be additionally supplied to an extraction and distillation device or the like, be separated into butadiene, butane, isobutane, and butylene, and these substances can be collected respectively. In addition to the above-described configuration, a butylene collection unit (not illustrated) is formed on the downstream side of the debutanization tower 18.

The higher boiling point component separated in the depentanizer tower 17, that is, the component having 6 or more carbon atoms, mainly contains a monocyclic aromatic hydrocarbon having 6 to 8 carbon atoms and is thus collected as cracked gasoline. In addition to the above-described configuration, a cracked gasoline collection unit 19 is formed on the downstream side of the depentanizer tower 17.

The cracked gasoline (BTX fraction) collected in the cracked gasoline collection unit 19 is supplied to a BTX refinement device 20 that separates the cracked gasoline into benzene, toluene, and xylene and then collects them respectively. Here, benzene, toluene, and xylene can also be respectively separated and collected and the BTX refinement device is desirably installed from the viewpoint of the production of chemical goods.

At this time, a component (C9+) having 9 or more carbon atoms contained in the cracked gasoline is separated from the BTX fraction and is collected in the BTX refinement device 20. It is also possible to install a device for separation in the BTX refinement device 20. The component having 9 or more carbon atoms can be used as a feedstock oil for producing an olefin and BTX described below similar to the thermally-cracked heavy oil separated in the thermally-cracked heavy oil separation step 3.

Next, a method for producing a hydrocarbon using the apparatus for producing ethylene, that is, a method for producing a monocyclic aromatic hydrocarbon having 6 to 8 carbon atoms according to the present invention, will be described with reference to FIGS. 1 and 2.

The apparatus for producing ethylene according to the present embodiment is an apparatus that, as illustrated in FIG. 1, produces an olefin and a BTX fraction in the cracking and reforming process 21 using the thermally-cracked heavy oil (HAR oil) separated and collected in the thermally-cracked heavy oil separation step 3, that is, mainly a hydrocarbon (aromatic hydrocarbon) having 9 or more carbon atoms heavier than the BTX fraction as a feedstock oil. In addition, it is also possible to use a heavy oil remaining after the collection of the BTX fraction from the cracked gasoline collection unit 19 as a feedstock.

In the latter part of the thermally-cracked heavy oil separation step 3, a part of fractions generated after the separation of the thermally-cracked heavy oil into a plurality of fractions or an oil remaining after other chemical goods or fuels are produced from the separated fractions is also a part of a residual oil (bottom oil) obtained from the cracking furnace 1 and is thus contained in the thermally-cracked heavy oil of the present invention, that is, a thermally-cracked heavy oil obtained from the apparatus for producing ethylene. Examples of the production of chemical goods or fuels from the separated fractions include the production of a petroleum resin from a light thermally-cracked heavy oil having approximately 9 or 10 carbon atoms. In addition, a part of fractions generated during the separation of a heavy oil fraction obtained by collecting the BTX fraction from the cracked gasoline collection unit 19 into a plurality of fractions or an oil remaining after other chemical goods or fuels are produced from the separated fractions is also, similarly, contained in the thermally-cracked heavy oil.

In the present embodiment, the apparatus has a configuration illustrated in FIG. 2 in order to carry out the cracking and reforming process 21. The configuration of the apparatus illustrated in FIG. 2 is intended to produce an olefin having 2 to 4 carbon atoms and a monocyclic aromatic hydrocarbon having 6 to 8 carbon atoms (BTX fraction) in which a thermally-cracked heavy oil obtained from the apparatus for producing ethylene is used as a feedstock oil and the olefin or BTX fraction is produced.

(Characteristics of Thermally-Cracked Heavy Oil)

While there is no particular specification, the thermally-cracked heavy oil in the present invention preferably has the following characteristics.

Characteristics obtained from a distillation test significantly vary depending on the cracking temperature or the cracking feedstock, but the 10 volume % distillate temperature (T10) is preferably in a range of 145° C. to 230° C. The 90 volume % distillate temperature (T90) and the end point vary more significantly depending on fractions being used and thus there is no limitation. However, when a fraction directly obtained from the thermally-cracked heavy oil separation step 3 is used, for example, the 90 volume % distillate temperature (T90) is preferably in a range of 400° C. to 600° C. and the end point (EP) is preferably in a range of 450° C. to 800° C.

It is preferable that the density at 15° C. be in a range of 1.03 g/cm$^3$ to 1.08 g/cm$^3$, the kinematic viscosity at 50° C. be in a range of 20 mm$^2$/s to 45 mm$^2$/s, the content of sulfur (sulfur component) be in a range of 200 ppm by mass to 700 ppm by mass, the content of nitrogen (nitrogen component) be 20 ppm by mass or less, and the aromatic component be 80% by volume or more.

Here, the distillation test refers to a test in which characteristics are measured according to "Testing Method For Distillation Of Petroleum Products" described in JIS K 2254, the density at 15° C. refers to the density measured according to "Vibrating Density Testing Method" of "Crude Petroleum And Petroleum Products-Determination Of Density And Petroleum Measurement Tables (excerpt)" described in JIS K 2249, the kinematic viscosity at 50° C. refers to a value obtained according to JIS K 2283 "Crude Petroleum And Petroleum Products-Determination Of Kinematic Viscosity And Calculation Method For Viscosity Index Of Crude Oil And Petroleum Products", the content of sulfur refers to the content of sulfur measured according to "Energy-Dispersive X-Ray Fluorescence Method" of "Crude Petroleum And Petroleum Products-Determination Of Sulfur Content" described in JIS K 2541-1992, the content of nitrogen refers to the content of nitrogen measured according to "Crude Petroleum And Petroleum Products-Determination Of Nitrogen Content" according to JIS K 2609, and the aromatic component refers to the content of total aromatic components measured using Japan Petroleum Institute Standard JP1-5S-49-97 "Hydrocarbon Type Testing Method For Petroleum Products Using High Performance Liquid Chromatography", respectively.

However, in the present embodiment, the thermally-cracked heavy oil is not directly used as a feedstock oil. The thermally-cracked heavy oil is distilled and separated in advance at a predetermined cut temperature (the 90 volume % distillate temperature is 390° C.) in an early distillation tower 30 illustrated in FIG. 2 and is separated into a light fraction (light thermally-cracked heavy oil) and a heavy fraction (heavy thermally-cracked heavy oil). In addition, a light fraction as described below is used as the feedstock oil. The heavy fraction is separately stored and is used as, for example, a fuel.

(Feedstock Oil)

The feedstock oil according to the present embodiment is an oil which is a thermally-cracked heavy oil obtained from the apparatus for producing ethylene and has a 90 volume % distillate temperature, as a distillation characteristic, of 390° C. or lower. That is, a light thermally-cracked heavy oil which has been distilled in the early distillation tower 30 and has a 90 volume % distillate temperature, which is a distillation characteristic, adjusted to 390° C. or lower is used as the feedstock oil. When the 90 volume % distillate temperature is set to 390° C. or lower as described above, an aromatic hydrocarbon having 9 to 12 carbon atoms becomes the main component of the feedstock oil and, in a cracking and reforming reaction step in which the contact and reaction with a catalyst for producing a monocyclic aromatic hydrocarbon described below are carried out, it is possible to increase the yield of a BTX fraction. In addition, in order to further increase the yield of a BTX fraction, it is preferable that the 10 volume % distillate temperature (T10) be in a range of 140° C. to 220° C. and the 90 volume % distillate temperature (T90) be in a range of 220° C. to 390° C. and it is more preferable that T10 be in a range of 160° C. to 200° C. and T90 be in a range of 240° C. to 350° C. In a case in which the 10 volume % distillate temperature (T10) and the 90 volume % distillate temperature (T90), which are the distillation characteristics of the feedstock oil, are 140° C. or higher and 390° C. or lower respectively when the feedstock oil is provided to the cracking and reforming process 21, it is not always necessary to carry out the distillation treatment in the early distillation tower 30.

Here, the distillation characteristics are measured according to "Testing Method For Distillation Of Petroleum Products" described in JIS K 2254.

The feedstock oil according to the present embodiment may include other base materials as long as the feedstock oil includes the thermally-cracked heavy oil obtained from the apparatus for producing ethylene.

As the feedstock oil according to the present embodiment, in addition to the light thermally-cracked heavy oil obtained by the distillation treatment in the early distillation tower 30, the component (aromatic hydrocarbon) having 9 or more carbon atoms separated and collected in the cracked gasoline collection unit 19 as described above can also be used.

In addition, for the fraction having distillation characteristics of a 10 volume % distillate temperature (T10) adjusted to 140° C. or higher and a 90 volume % distillate temperature (T90) adjusted to 390° C. or lower in the previous treatment (pretreatment), it is not always necessary to carry out distillation in the early distillation tower 30. Therefore, as described below, separately from a thermally-cracked heavy oil illustrated in FIG. 2, it is also possible to directly supply the feedstock oil to a hydrogenation reaction device 31 or a cracking and reforming reaction device 33 which is a device that configures the cracking and reforming process 21 provided behind the early distillation tower 30.

Part or all of the feedstock oil obtained as described above is partially hydrogenated using the hydrogenation reaction device 31. That is, part or all of the feedstock oil is provided to a hydrogenation reaction step.

In the present embodiment, only the light thermally-cracked heavy oil, that is, only part of the feedstock oil, is partially hydrogenated. On a component mainly containing a hydrocarbon having 9 carbon atoms or a component having 9 or more carbon atoms separated and collected in the cracked gasoline collection unit 19 out of a part of fractions generated during the separation of the thermally-cracked heavy oil into a plurality of fractions or an oil remaining after other chemical goods or fuels are produced from the separated fractions, the hydrogenation treatment may not be carried out. However, it is needless to say that, even on the above-described components, the partial hydrogenation treatment may be carried out using the hydrogenation reaction device 31.

(Refinement and Collection of Olefin and BTX Fraction)

A cracking and reforming reaction product derived from the cracking and reforming reaction device 33 contains a gas containing an olefin having 2 to 4 carbon atoms, a BTX fraction, and an aromatic hydrocarbon of C9 or more. Therefore, the cracking and reforming reaction product is separated into the respective components, refined, and collected using a refinement and collection device 34 provided behind the cracking and reforming reaction device 33.

The refinement and collection device 34 includes a BTX fraction collection tower 35 and a gas separation tower 36.

In the BTX fraction collection tower 35, the cracking and reforming reaction product is distilled and separated into a light fraction having 8 or less carbon atoms and a heavy fraction having 9 or more carbon atoms. In the gas separation tower 36, the light fraction having 8 or less carbon atoms separated in the BTX fraction collection tower 35 is distilled and separated into a BTX fraction containing benzene, toluene, and coarse xylene and a gas fraction having a boiling point lower than that of the BTX fraction. In the BTX fraction collection tower 35 and the gas separation tower 36, the fractions obtained from the respective towers are retreated and thus it is not necessary to increase the distillation accuracy and it is possible to carry out the distillation operation in a relatively brief manner.

(Product Collection Step)

As described above, in the gas separation tower 36, since the distillation operation is carried out in a relatively brief manner, the gas fraction separated in the gas separation tower 36 mainly contains hydrogen, C4 fractions such as ethylene, propylene, and butylene, and BTX. Therefore, the gas fraction, that is, a gas fraction that serves as a part of the product obtained in the cracking and reforming reaction step, is treated again in the product collection device 2 as illustrated in FIG. 1. That is, the gas fraction is provided to the thermally-cracked heavy oil separation step 3 together with the cracking product obtained in the cracking furnace 1. In addition, hydrogen or methane is separated and collected by treating the gas fraction mainly using the cracked gas compressor 4, the demethanizer tower 6, and the like and, furthermore, the gas fraction is treated using the deethanizer tower 9 and the ethylene-rectifying tower 10 so as to collect ethylene. In addition, the gas fraction is treated using the depropanizing tower 13 and the propylene-rectifying tower 14 so as to collect propylene and is treated using the depentanizer tower 17, the debutanization tower 18, and the like so as to collect a cracked gasoline (BTX fraction) such as butylene or butadiene.

Benzene, toluene, and xylene separated using the gas separation tower 36 illustrated in FIG. 2 are provided to the BTX refinement device 20 illustrated in FIG. 1, and benzene, toluene, and xylene are respectively refined and rectified so as to be separated and collected as products. In addition, in the present embodiment, BTX is collectively collected, but may be respectively and separately collected using the configuration of the apparatus and the like in the latter part. For example, xylene may be directly supplied to an apparatus for producing paraxylene or the like instead of the BTX refinement device.

(Recycling Step)

The heavy fraction (bottom fraction) having 9 or more carbon atoms separated in the BTX fraction collection tower 35 is returned to the hydrogenation reaction device 31 through a recycling path 37 (recycling step) which is recycle means and is again provided to the hydrogenation reaction step together with the light thermally-cracked heavy oil derived from the early distillation tower 30. That is, the heavy fraction (bottom fraction) is returned to the cracking and reforming reaction device 33 through the hydrogenation reaction device 31 and is provided to the cracking and reforming reaction step. In the recycling step (recycling path 37), for example, a heavy component having a 90 volume % distillate temperature (T90), as a distillation characteristic, of higher than 390° C. is preferably cut back before being provided to the hydrogenation reaction device 31 (hydrogenation reaction step) and stored with the heavy thermally-cracked heavy oil. Even in a case in which a fraction having a 90 volume % distillate temperature (T90) of higher than 390° C. is rarely contained, it is preferable to discharge a certain amount of the fraction outside the system when fractions having a low reactivity are accumulated or the like.

Thus far, the refinement, collection, and recycling to the cracking and reforming reaction step of the cracking and reforming reaction product derived from the cracking and reforming reaction device 33 have been described, but it is also possible to return all the cracking and reforming reaction product to the product collection device 2 in the apparatus for producing ethylene and collect and treat the cracking and reforming reaction product and, in this case, the installment of the refinement and collection device 34 is not required. In addition, it is also possible to recycle the heavy fraction (bottom fraction) having 9 or more carbon atoms obtained from the bottom of the BTX fraction collection tower 35 to the hydrogenation reaction device 31, return the fraction having 8 or less carbon atoms obtained from the top of the tower to the product collection device 2 in the apparatus for producing ethylene, and treat the fractions at the same time.

According to the method for producing a monocyclic aromatic hydrocarbon having 6 to 8 carbon atoms of the present embodiment, since a product containing BTX is obtained by bringing the feedstock oil and methane into contact with the catalyst for producing a monocyclic aromatic hydrocarbon loaded into the cracking and reforming reaction device 33 (fixed-bed reactor) and reacting the feedstock oil and methane, it is possible to suppress the attachment of coke to the catalyst surface and suppress the deterioration of the catalyst by making methane, which is rarely reactive in the cracking and reforming reaction device 33, coexist with the feedstock oil so as to act as a diluting agent. Therefore, the production efficiency of BTX can be increased and the frequency of the reproduction of the catalyst can be decreased or the reproduction time can be shortened and thus it is possible to reduce the operational costs of the cracking and reforming reaction device 33. Therefore, it is possible to reduce the production cost of BTX. In addition, the use of the fixed-bed reactor having a price that is inexpensive compared with a fluidized-bed reactor as the cracking and reforming reaction device 33 can also reduce the production cost of BTX.

In addition, the feedstock oil made of a partially-hydrogenated substance of the thermally-cracked heavy oil obtained from the apparatus for producing ethylene is cracked and reformed using the cracking and reforming reaction device 33 and a part of the obtained product is collected and treated in the product collection device 2 in the apparatus for producing ethylene and thus it is possible to easily collect a light olefin produced as a byproduct from the cracking and reforming reaction device 33 using the existing product collection device 2 without building a new device. Therefore, an increase in the cost is suppressed and a light olefin can be produced with higher production efficiency. In addition, it is also possible to efficiently produce BTX using the cracking and reforming reaction device 33.

In addition, since two or more fixed-bed reactors are used as the cracking and reforming reaction device 33 and the cracking and reforming reaction and the reproduction of the catalyst for producing an olefin and a monocyclic aromatic hydrocarbon are repeated by periodically switching the reactors, it is possible to produce the BTX fraction with high production efficiency. In addition, since the fixed-bed reactor of an apparatus cost that is extremely lower compared with that of the fluidized-bed reactor is used, it is possible to suppress the cost of the configuration of the apparatus used for the cracking and reforming process 21 at a sufficiently low level. Furthermore, since the light olefin generated together with the BTX fraction can also be easily collected using the existing product collection device 2 in the apparatus for producing ethylene, it is also possible to produce the light olefin with high production efficiency together with the BTX fraction.

The present invention is not limited to the embodiment and a variety of modifications are permitted within the scope of the gist of the present invention.

For example, in the present embodiment, the thermally-cracked heavy oil obtained from the apparatus for producing ethylene or the partially-hydrogenated substance of the thermally-cracked heavy oil is used as the feedstock oil; however, as the feedstock oil of the present invention, any oils other than the thermally-cracked heavy oil or the partially-hydrogenated substance of the thermally-cracked heavy oil may be used as long as the 10 volume % distillate temperature is 140° C. or higher and the 90 volume % distillate temperature is 390° C. or lower. Specifically, a cracked light oil (LCO) which satisfies the distillation characteristics and is produced in the FCC apparatus or a partially-hydrated substance of the cracked light oil may be used as the feedstock oil of the present invention. In this case as well, it is possible to reduce the production cost of BTX. In addition, even a mixture of a plurality of the feedstock oils can be used as the feedstock oil of the present application as long as the distillation characteristics of a 10 volume % distillate temperature of 140° C. or higher and a 90 volume % distillate temperature of 390° C. or lower are satisfied. In this case as well, the production cost of the BTX fraction can be reduced.

In addition, in the embodiment, the cracking and reforming reaction is caused using the cracking and reforming reaction device 33 and a part of the obtained product is collected using the product collection device 2 in the apparatus for producing ethylene, but all of the product obtained from the cracking and reforming reaction may be collected using the product collection device 2 in the apparatus for producing ethylene.

Furthermore, in the present embodiment, a part of the product obtained through the cracking and reforming reaction in the cracking and reforming reaction device 33 is collected in the product collection device 2 in the apparatus for producing ethylene, but it is also possible to carry out a collection treatment on the respective components using collection devices in other plants different from the apparatus for producing ethylene instead of carrying out a collection treatment on the product obtained through the cracking and reforming reaction using the product collection device 2 in the apparatus for producing ethylene. Examples of the other apparatuses include an FCC apparatus.

EXAMPLES

Hereinafter, the present invention will be more specifically described based on examples and comparative examples but the present invention is not limited to these examples.

[Method for Producing Hydrogenated Oil of Feedstock Oil]

(Preparation of Catalyst for Hydrogenation Treatment)

Water glass No. 3 was added to 1 kg of an aqueous solution of sodium aluminate having a concentration of 5% by mass and the components were put into a container held at 70° C. A solution obtained by adding an aqueous solution of titanium sulfate (IV) (24% by mass in terms of the content of $TiO_2$) to 1 kg of an aqueous solution of aluminum sulfate having a concentration of 2.5% by mass was prepared in another container held at 70° C. and this solution was added dropwise to an aqueous solution including the sodium aluminate for 15 minutes. The amounts of the water glass and the aqueous solution of titanium sulfate were adjusted so as to obtain predetermined contents of silica and titania.

A point in time when the pH of the mixed solution fell in a range of 6.9 to 7.5 was set as an end point, and the obtained slurry-form product was filtered through a filter, thereby obtaining a cake-form slurry. The cake-form slurry was moved to a container equipped with a reflux condenser, 300 ml of distilled water and 3 g of an aqueous solution of 27% ammonia were added, and were heated and stirred at 70° C. for 24 hours. The stirred slurry was put into a kneading apparatus, was heated at 80° C. or higher, and was kneaded while removing moisture, thereby obtaining a clay-form kneaded substance.

The obtained kneaded substance was extracted into a cylinder shape having a diameter of 1.5 mm using an extruder, was dried at 110° C. for 1 hour, and then was fired at 550° C., thereby obtaining a shaped carrier. The obtained shaped carrier was taken as much as 300 g and was soaked with a soaking solution, which was prepared by adding molybdic anhydride, cobalt (II) nitrate hexahydrate, and phosphoric acid (having a concentration of 85%) to 150 ml of distilled water and adding malic acid until the components were dissolved, through spraying.

The amounts of the molybdic anhydride, the cobalt (II) nitrate hexahydrate, and the phosphoric acid used were adjusted so as to obtain a predetermined support amount. A specimen soaked with a soaking solution was dried at 110° C. for 1 hour and then was fired at 550° C., thereby obtaining a catalyst A. In the catalyst A, the content of $SiO_2$ was 1.9% by mass and the content of $TiO_2$ was 2.0% by mass in terms of the carrier, and the amount of $MoO_3$ supported was 22.9% by mass, the amount of CoO supported was 2.5% by mass, and the amount of $P_2O_5$ supported was 4.0% by mass in terms of the catalyst.

(Preparation of Feedstock Oil)

Only the light component was separated from a thermally-cracked heavy oil obtained from the apparatus for producing ethylene illustrated in FIG. 1 through a distillation operation, thereby preparing a thermally-cracked heavy oil A. In addition, a cracked light oil B obtained from an FCC apparatus was prepared. The characteristics of the respective feedstock oils are described in Table 1.

TABLE 1

| Name | | Thermally-cracked heavy oil A | Cracked light oil B |
|---|---|---|---|
| Density, g/ml (15° C.) | | 0.9903 | 0.9328 |
| Kinematic viscosity, $mm^2/s$ (30° C.) | | — | 3.007 |
| Kinematic viscosity, $mm^2/s$ (40° C.) | | 1.6010 | — |
| Sulfur component, % by mass | | 0.025 | 0.16 |
| Distillation characteristics, ° C. | IBP | 194 | 182 |
| | T10 | 211 | 213 |
| | T90 | 256 | 343 |
| | EP | 291 | 373 |
| Saturated components, % by mass | | 1 | 21 |
| Aromatic components, % by mass | | 98 | 76 |
| Bicyclic or more aromatic components, % by mass | | 77 | 46 |

(Hydrogenation Reaction of Feedstock Oil)

The catalyst A was loaded into a fixed-bed continuous circulation-type reaction apparatus and, first, the preliminary sulfurization of the catalyst was carried out. That is, to a fraction (preliminary sulfurization feedstock oil) corresponding to a straight distillation-based light oil having a density at 15° C. of 851.6 $kg/m^3$, an initial boiling point of 231° C. and a finishing boiling point of 376° C. in a distillation test, a content of a sulfur component of 1.18% by mass in terms of a sulfur atom on the basis of the mass of the preliminary sulfurization feedstock oil, and a hue of L1.5, 1% by mass of DMDS in terms of the mass of the fraction was added, and the mixture was continuously supplied to the catalyst A for 48 hours. After that, the thermally-cracked heavy oil A and the cracked light oil B described in Table 2 were respectively used as the feedstock oils and a hydrogenation treatment was carried out at a reaction temperature of 300° C., LHSV=1.0 $h^{-1}$, a hydrogen oil ratio of 500 NL/L, and a pressure of 3 MPa. The characteristics of the obtained hydrogenated thermally-cracked heavy oil A-1 and hydrogenated cracked light oil B-1 are described in Table 2.

TABLE 2

| Name | | Hydrogenated thermally-cracked heavy oil A-1 | Hydrogenated cracked light oil B-1 |
|---|---|---|---|
| Density, g/ml (15° C.) | | 0.9498 | 0.9051 |
| Kinematic viscosity, $mm^2/s$ (30° C.) | | — | 2.938 |
| Kinematic viscosity, $mm^2/s$ (40° C.) | | 1.616 | — |
| Sulfur component, % by mass | | 0.0003 | 0.0003 |
| Distillation characteristics, ° C. | IBP | 192 | 189 |
| | T10 | 201 | 212 |
| | T90 | 252 | 330 |
| | EP | 314 | 368 |
| Saturated components, % by mass | | 8 | 34 |
| Aromatic components, % by mass | | 92 | 66 |
| Bicyclic or more aromatic components, % by mass | | 5 | 10 |

The distillation characteristics in Tables 1 and 2 were respectively measured according to "Testing Method For Distillation Of Petroleum Products" described in JIS K 2254. In addition, the density at 15° C. in Table 1 was measured according to "Testing Method For Distillation Of Petroleum Products" described in JIS K 2254, the kinematic viscosity at 30° C. and 40° C. was measured according to "Crude Petroleum And Petroleum Products-Determination Of Kinematic Viscosity And Calculation Method For Viscosity Index Of Crude Oil And Petroleum Products" described in JIS K 2283, and the content of sulfur was measured according to "Crude Petroleum And Petroleum Products-Determination Of Sulfur Content" described in JIS K 2541, respectively.

In addition, the respective compositions in Tables 1 and 2 were computed by carrying out a mass analysis (apparatus: manufactured by JEOL Ltd., JMS-700) through an E1 ionization method on saturated components and aromatic components obtained through silica gel chromate fractionation and carrying out the type analysis of hydrocarbons according to ASTM D2425 "Standard Test Method for Hydrocarbon Types in Middle Distillates by Mass Spectrometry".

Method for Producing Olefin and Aromatic Hydrocarbon

Preparation Example 1 of Catalyst for Producing Monocyclic Aromatic Hydrocarbon

Preparation of Phosphorous-Containing Proton-Type MFI Zeolite

A solution (A) made up of 1706.1 g of sodium silicate (J silicate soda No. 3, $SiO_2$: 28% by mass to 30% by mass, Na: 9% by mass to 10% by mass, the balance of water, manufactured by Nippon Chemical Industrial Co., Ltd.) and 2227.5 g of water and a solution (B) made up of 64.2 g of $Al_2(SO_4)_3 \cdot 14$ to $18H_2O$ (special grade chemical, manufactured by Wako Pure Chemical Industries, Ltd.), 369.2 g of tetrapropylammonium bromide, 152.1 g of $H_2SO_4$ (97% by mass), 326.6 g of NaCl, and 2975.7 g of water were prepared respectively.

Next, while the solution (A) was stirred at room temperature, the solution (B) was slowly added to the solution (A). The obtained mixture was vigorously stirred for 15 minutes using a mixer, a gel was crushed and thus was put into a homogeneous fine milky state.

Next, the mixture was put into a stainless steel autoclave and a crystallization operation was carried out under the self-pressure under conditions in which the temperature was set to 165° C., the time was set to 72 hours, and the stirring rate was set to 100 rpm. After the end of the crystallization operation, the product was filtered so as to collect the solid product and washing and filtration were repeated 5 times using approximately 5 liters of deionized water. A solid substance obtained through filtration was dried at 120° C. and, furthermore, was fired at 550° C. for 3 hours under air circulation.

As a result of an X-ray diffraction analysis (instrument name: Rigaku RINT-2500V), the obtained fired substance was confirmed to have an MFI structure. In addition, the $SiO_2/Al_2O_3$ ratio (molar ratio) obtained through a fluorescent X-ray analysis (instrument name: Rigaku ZSX101e) was 65. In addition, the content of an aluminum element contained in the lattice skeleton computed from the result was 1.3% by mass.

Next, an aqueous solution of 30% by mass of ammonium nitrate was added at a proportion of 5 mL per gram of the obtained fired substance, the mixture was heated and stirred at 100° C. for 2 hours, then, was filtered and washed with water. This operation was repeated 4 times and then the mixture was dried at 120° C. for 3 hours, thereby obtaining an ammonium-type MFI zeolite. After that, firing was carried out at 780° C. for 3 hours, thereby obtaining a proton-type MFI zeolite.

Next, 30 g of an aqueous solution of diammonium hydrogen phosphate was soaked into 30 g of the obtained proton-type MFI zeolite so that 2.0% by mass of phosphorous (a value when the total mass of the proton-type MFI zeolite was set to 100% by mass) was supported and was dried at 120° c. After that, the zeolite was fired at 780° C. for 3 hours under air circulation, thereby obtaining a phosphorous-containing proton-type MFI zeolite. In order to exclude the influence on the initial activity of the obtained catalyst, a hydrothermal treatment was carried out in an environment of a treatment temperature of 650° C., a treatment time of 6 hours, and 100% by mass of water vapor.

"Preparation of Phosphorous-Containing Proton-Type BEA Zeolite"

A first solution was prepared by dissolving 59.1 g of silicic acid ($SiO_2$: 89% by mass) in 202 g of an aqueous solution of tetraethylammnoium hydroxide (40% by mass). The first solution was added to a second solution prepared by dissolving 0.74 g of an A1 pellet and 2.69 g of sodium hydroxide in 17.7 g of water. The first solution and the second solution were mixed together as described above, thereby obtaining a reaction mixture having a composition (in terms of the molar ratio of an oxide) of $2.4Na_2O$-20.0 $(TEA)_2$-$Al_2O_3$-$64.0SiO_2$-$612H_2O$.

This reaction mixture was put into a 0.3 L autoclave and was heated at 150° C. for 6 days. In addition, the obtained product was separated from the parent liquid and was washed with distilled water.

As a result of an X-ray diffraction analysis (instrument name: Rigaku R1NT-2500V) of the obtained product, the product was confirmed to be a BEA-type zeolite from the XRD pattern.

After that, ions were exchanged using an aqueous solution of ammonium nitrate (30% by mass), the BEA-type zeolite was fired at 550° C. for 3 hours, thereby obtaining a proton-type BEA zeolite.

"Preparation of Catalyst Including Phosphorous-Containing Proton-Type BEA Zeolite"

Next, 30 g of an aqueous solution of diammonium hydrogen phosphate was soaked into 30 g of the proton-type BEA zeolite so that 2.0% by mass of phosphorous (a value when the total mass of the crystalline aluminosilicate was set to 100% by mass) was supported and was dried at 120° c. After that, the zeolite was fired at 780° C. for 3 hours under air circulation, thereby obtaining a catalyst containing the proton-type BEA zeolite and phosphorous. In order to exclude the influence on the initial activity of the obtained catalyst, a hydrothermal treatment was carried out in an environment of a treatment temperature of 650° C., a treatment time of 6 hours, and 100% by mass of water vapor. After that, a pressure of 39.2 MPa (400 kgf) was applied to the hydrothermal deterioration treatment catalyst obtained by mixing 9 parts of the hydrothermally-treated phosphorous-containing proton-type MFI zeolite with 1 part of the phosphorous-supported proton-type BEA zeolite that had been, similarly, hydrothermally treated so as to carry out tablet compression and the catalyst was coarsely crushed so as to have sizes in a range of 20 mesh to 28 mesh, thereby obtaining a granular body of a catalyst B.

Examples 1 to 4 and Comparative Examples 1 and 2

Production of Olefin and Aromatic Hydrocarbon

Each of the respective feedstock oils described in Table 3 and a diluting material were introduced into a reactor at a predetermined ratio using a circulation-type reaction apparatus having a reactor loaded with the catalyst B (10 ml) and the feedstock oil and the catalyst were brought into contact with and were reacted with each other under a condition in which the reaction temperature was set to 550° C., the reaction pressure was set to 0.1 MPaG, and the contact time between the feedstock and the catalyst was set to 25 seconds. The feedstock oils used and the diluting agent were combined together so as to produce Examples 1 to 4 and Comparative Examples 1 and 2 as described in Table 3.

TABLE 3

| | | Example 1 | Example 2 | Example 3 | Example 4 | Comparative Example 1 | Comparative Example 2 |
|---|---|---|---|---|---|---|---|
| Feedstock | | Hydrogenated thermally-cracked heavy oil A-1 | Hydrogenated thermally-cracked heavy oil A-1 | Hydrogenated thermally-cracked light oil B-1 | Hydrogenated thermally-cracked light oil B-1 | Hydrogenated thermally-cracked heavy oil A-1 | Hydrogenated thermally-cracked light oil B-1 |
| Reaction time (h) | | 24 | 24 | 24 | 24 | 24 | 24 |
| Diluting material | | Methane | Methane | Methane | Methane | None | None |
| Diluting material/ feedstock ratio | | 4 | 1 | 4 | 1 | 0 | 0 |
| Yield (% by mass) | Olefin | 3 | 2 | 2 | 2 | 2 | 2 |
| | Gas and naphtha other than olefin | 7 | 5 | 16 | 13 | 5 | 13 |
| | BTX | 42 | 30 | 24 | 20 | 28 | 18 |
| | Heavy component | 48 | 63 | 58 | 65 | 65 | 67 |

Reactions were caused under the above-described conditions for the times described in Table 3 so as to produce olefins having 2 to 4 carbon atoms and monocyclic aromatic hydrocarbons having 6 to 8 carbon atoms (benzene, toluene, and xylene) and the compositional analyses of the products were carried out through an FID gas chromatograph directly coupled to the reaction apparatus so as to evaluate the catalyst activities. The evaluation results are described in Table 3. Here, the olefin refers to an olefin having 2 to 4 carbon atoms, BTX refers to an aromatic compound having 6 to 8 carbon atoms, the heavy component refers to a product heavier than BTX, and the gas and naphtha other than the olefin refer to products other than the olefin, BTX, and the heavy component.

From the results described in Table 3, it was found that, in Examples 1 to 4 in which the saturated hydrocarbon having 1 to 3 carbon atoms coexisted with the feedstock as a diluting material, it was possible to produce an olefin having 2 to 4 carbon atoms and a monocyclic aromatic hydrocarbon having 6 to 8 carbon atoms (benzene, toluene, or xylene) with a favorable yield in contrast to Comparative Examples 1 and 2 in which the saturated hydrocarbon did not coexist. In addition, Table 4 describes the amounts of coke generated in Example 1 and Comparative Example 1 and it was found that the generation of coke was suppressed by the introduction of a diluting agent. That is, when a certain amount or more of the diluting material was introduced, the generation of coke could be suppressed and, consequently, while no huge difference in the yields of the olefin and BTX was caused, the yield of BTX significantly decreased without the diluting material.

Therefore, it was confirmed that, in Examples 1 to 4 of the present invention, it was possible to efficiently produce an olefin and BTX by introducing a light hydrocarbon.

TABLE 4

| | Example 1 | Example 2 |
|---|---|---|
| Coke yield (% by mass) | 0.12 | 0.33 |

INDUSTRIAL APPLICABILITY

The present invention relates to a method for producing a monocyclic aromatic hydrocarbon. According to the present invention, it is possible to suppress the production cost of BTX.

REFERENCE SIGNS LIST

1 CRACKING FURNACE
31 HYDROGENATION REACTION DEVICE
33 CRACKING AND REFORMING REACTION DEVICE (FIXED-BED REACTOR)

The invention claimed is:

1. A method for producing a monocyclic aromatic hydrocarbon, comprising:

a dilution step of mixing a feedstock oil having a 10 volume % distillate temperature of 140° C. or higher and a 90 volume % distillate temperature of 390° C. or lower with a saturated hydrocarbon comprising methane to obtain a diluted feedstock oil in which a ratio of the saturated hydrocarbon to the feedstock oil is in a range of 20 NL/L to 2000 NL/L; and a cracking and reforming reaction step of obtaining a product containing a monocyclic aromatic hydrocarbon having 6 to 8 carbon atoms by bringing the diluted feedstock oil into contact with a catalyst containing crystalline aluminosilicate which is loaded into a fixed-bed reactor.

2. The method for producing a monocyclic aromatic hydrocarbon according to claim 1, wherein the saturated hydrocarbon is methane.

3. The method for producing a monocyclic aromatic hydrocarbon according to claim 1, wherein the feedstock oil is a thermally-cracked heavy oil obtained from an apparatus for producing ethylene and a partially-hydrogenated substance of the thermally-cracked heavy oil.

4. The method for producing a monocyclic aromatic hydrocarbon according to claim 1, wherein the feedstock oil is a cracked light oil or a partially-hydrogenated substance of the cracked light oil.

5. The method for producing a monocyclic aromatic hydrocarbon according to claim 1, wherein, in the cracking and reforming reaction step, two or more fixed-bed reactors are used and a cracking and reforming reaction and a reproduction of coked catalyst are repeated while the two or more fixed-bed reactors are periodically switched.

6. The method for producing a monocyclic aromatic hydrocarbon according to claim 1, wherein the crystalline aluminosilicate contained in the catalyst includes a medium-pore zeolite and/or a large-pore zeolite as a main component.

7. The method for producing a monocyclic aromatic hydrocarbon according to claim 1, wherein the catalyst contains phosphorous.

* * * * *